US006450864B1

(12) United States Patent
Smith

(10) Patent No.: US 6,450,864 B1
(45) Date of Patent: Sep. 17, 2002

(54) END MILL GRINDER WITH TWO INDEPENDENTLY ADJUSTABLE GRINDING WHEELS

(76) Inventor: Raphael W. Smith, 1423 Winding Brook Cir. #287, Dallas, TX (US) 75208

( * ) Notice: Subject to any disclaimer, the term of this patent is extended or adjusted under 35 U.S.C. 154(b) by 0 days.

(21) Appl. No.: 09/687,492

(22) Filed: Oct. 13, 2000

(51) Int. Cl.[7] ..... B24B 3/12
(52) U.S. Cl. ..... 451/48; 451/177; 451/366
(58) Field of Search ..... 451/48, 177, 366, 451/375, 379

(56) References Cited

U.S. PATENT DOCUMENTS

| | | | | | |
|---|---|---|---|---|---|
| 1,606,813 | A | * | 11/1926 | Schultz | 451/293 X |
| 1,647,131 | A | * | 11/1927 | Heim | 451/49 |
| 2,556,843 | A | * | 6/1951 | Hollengreen et al. | 451/48 |
| 2,624,159 | A | | 1/1953 | Balsiger | 51/103 |
| 3,626,645 | A | * | 12/1971 | Rochet | 451/48 |
| 3,905,159 | A | * | 9/1975 | Stanaback | 451/48 X |
| 4,183,182 | A | * | 1/1980 | Kotthaus | 51/288 |
| 4,186,529 | A | | 2/1980 | Huffman | 51/288 |
| 4,442,637 | A | | 4/1984 | Ahejew | 51/288 |
| 4,691,479 | A | * | 9/1987 | Helle | 451/48 X |
| 5,054,266 | A | | 10/1991 | Norris | 51/111 |
| 5,381,630 | A | | 1/1995 | Kinner | 451/63 |
| 5,649,853 | A | | 7/1997 | Kuo | 451/178 |
| 5,807,164 | A | | 9/1998 | Junker | 451/47 |
| 6,283,830 | B1 | * | 9/2001 | Kuo | 451/48 X |

FOREIGN PATENT DOCUMENTS

| | | | | |
|---|---|---|---|---|
| DE | 2629130 | * | 1/1978 | 451/48 |
| EP | 0405338 A2 | | 6/1990 | |
| WO | WO 96/05940 | | 6/1995 | |

* cited by examiner

*Primary Examiner*—Joseph J. Hail, III
*Assistant Examiner*—Anthony Ojini
(74) *Attorney, Agent, or Firm*—Michael L. Diaz

(57) ABSTRACT

An end mill grinder have two independently adjustable grinding wheels. The end mill grinder includes two grinding wheels which are located next to each other. Each grinding wheel is rotated by a motor. The grinding wheels are positioned in a manner which allows the first grinding wheel to grind primary clearances of the end mill, while the second grinding wheel grinds secondary clearances of the end mill. The end mill is guided toward the grinding wheels by a finger guide attached to a carriage which supports and retains the end mill. The end mill grinder allows the grinding of primary and secondary clearances in one step.

17 Claims, 3 Drawing Sheets

END MILL GRINDER WITH TWO INDEPENDENTLY ADJUSTABLE GRINDING WHEELS

BACKGROUND OF THE INVENTION

1. Technical Field of the Invention

This invention relates to grinders, and more particularly, to an end mill grinder having two independently adjustable grinding wheels.

2. Description of Related Art

End mills are cutting tools commonly used in the manufacturing industry. An end mill typically has a plurality of helical cutting surfaces (flutes) having primary and secondary cutting surfaces, or clearances. Since the primary and secondary clearances directly contact a work piece during a cutting operation, the clearances eventually wear down. Thus, the primary and secondary clearances require periodic grinding or sharpening. Typically an end mill grinder utilizes a rotating cup wheel which is used to abrasively grind the clearances to sharpened edges. However, the typical process involves a two step procedure. First, the end mill is placed within an end mill grinder, adjusting the cup wheel to accommodate the sharpening of the primary clearance. An operator then sharpens the primary clearance of the end mill. In the next step, the cup wheel and end mill are positioned in a different manner for the sharpening of the secondary clearance. The operator then has to sharpen the secondary clearance of the end mill. A device is needed which provides an efficient and cost effective device for grinding the primary and secondary clearances of a tool having helical cutting surfaces.

Although there are no known prior art teachings of a solution to the aforementioned deficiency and shortcoming such as that disclosed herein, prior art references that discuss subject matter that bears some relation to matters discussed herein are U.S. Pat. No. 4,186,529 to Huffman (Huffman), U.S. Pat. No. 4,442,637 to Ahejew (Ahejew), U.S. Pat. No. 5,381,630 to Kinner (Kinner), and Patent Cooperation Treaty (PCT) Application Number WO 96/05940 to Laycock (Laycock).

Huffman discloses a method of grinding cutting edges and clearance surfaces on cutting tools such as end mills. A programmable servo-motor type control is utilized. All the grinding operations are completed at a single station in a series of consecutive grinding operations performed by the same grinding wheel and during which the tool remains in the same work holder. The various cutting edges and clearance surfaces to be ground are mathematically located and defined such that the grinding operations may be conducted under numerical control. However, Huffman does not teach or suggest two grinding wheels for simultaneously grinding a work piece. Huffman merely discloses a device which grinds a work piece with one grinding wheel in a series of operations. Thus, Huffman suffers from the disadvantages of requiring two or more steps to grind the work piece.

Ahejew discloses a simultaneously double-acting split abrasive grinding wheel for sharpening helix tools, such as end mill cutters. The wheel includes adjacent spaces and abrasive working strips of different proportions. The wheel is adapted in its use to a single pass, one-step operation which imparts primary relief angles, secondary clearances, and primary relief width spacing on the peripheral land surfaces of the tools being finished. However, Ahejew does not teach or suggest two independently adjustable grinding wheels for simultaneously grinding a cutting tool. Ahejew suffers from the disadvantage of utilizing a single grinding wheel which must be constructed for each type and size of cutting tool. A device is needed which can be utilized on a variety of end mills of different sizes.

Kinner discloses a resurfacing method and apparatus for brake disks or rotors utilizing dead centers to support the rotor, thus avoiding disk thickness variations which would result from support of the disk on roller bearings. Abrasive grinding wheels may then be used to effect the resurfacing of the disk, rotating in such a way relative to the disk rotation that a desired, surface pattern is produced on the disk. Kinner does not teach or suggest the independent movement of the grinding wheels. Additionally, Kinner is unable to grind primary and secondary grinding surfaces on an end mill. Kinner merely discloses a method and apparatus for grinding flat surfaces associated with brake rotors, but not helical cutting surfaces associated with end mills.

Laycock discloses a method and apparatus for dressing the grinding wheels of a dual head grinding machine. A dual wheel head grinding machine is disclosed having two heads. Each head carries a grinding wheel and a wheel dresser. The wheel heads are relatively movable to enable the first dresser to dress the second grinding wheel, or to enable the second dresser to dress the first grinding wheel. The two wheel heads are preferably movable in two coordinate direction. However, Laycock does not teach or suggest utilizing the two grinding wheels to simultaneously grind a work piece. Laycock merely discloses a device for dressing the grinding wheels.

Review of the foregoing references reveals no disclosure or suggestion of an apparatus or method as that described and claimed herein. Thus, it would be a distinct advantage to have an end mill grinder which utilizes independently adjustable grinding wheels to grind primary and secondary clearances on a cutting tool in a one step grinding operation. It is an object of the present invention to provide such an apparatus or method.

SUMMARY OF THE INVENTION

In one aspect, the present invention is an end mill grinder for grinding an end mill having a plurality of primary and secondary clearances. The end mill grinder includes a first grinding wheel for grinding the primary clearances of the end mill and a second grinding wheel for grinding the secondary clearances of the end mill. The second grinding wheel is located adjacent to the first grind wheel. Each grinding wheel includes a motor for rotating the grinding wheel. In addition, the end mill grinder includes a carriage located slightly below and adjacent the first and second grinding wheels, a finger guide attached to the carriage, and an end mill retainer for holding the end mill. The end mill retainer is attached to the carriage. The finger guide guides the end mill to move toward the first and second grinding wheels to simultaneously allow the first grinding wheel to grind the primary clearances and the second grind wheel to grind the secondary clearances of the end mill.

In another aspect, the present invention is an end mill grinder for grinding an end mill having a plurality of primary and secondary clearances. The end mill grinder includes a first grinding wheel for grinding the primary clearances of the end mill and a second grinding wheel for grinding the secondary clearances of the end mill. The second grinding wheel is located adjacent to the first grind wheel. The grinding wheels are rotationally driven by separate motors. In addition, the grinding wheels can be independently adjusted in position. A carriage is located slightly below and adjacent the first and second grinding wheels. The carriage has a finger guide and is rotatable to allow the end mill to be positioned on the finger guide prior to contacting the first and second grinding wheels. An end mill retainer is attached to the carriage for holding the end mill. The finger guide guides the end mill to simultaneously allow the first grinding wheel to grind the primary clearances and the second grinding wheel to grind the secondary clearances of the end mill.

In still another aspect, the present invention is a method of grinding a plurality of primary clearances and secondary clearances of an end mill in one grinding process. The method begins by adjusting a position of a first grinding wheel in relation to a second grinding wheel. The position allowing an outer edge of the first grinding wheel to grind the primary clearance of the end mill and an outer edge of the second grinding wheel to grind the secondary clearance of the end mill. Next, the end mill is affixed to a carriage having a finger guide. The first and second grinding wheels are then rotated. Next, the end mill is rotationally and horizontally translated to contact the rotating first and second grinding wheels. The first grinding wheel grinds the primary clearances and the second grinding wheel simultaneously grinds the secondary clearances of the end mill.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

An end mill grinder having two independently adjustable grinding wheels utilized in a one step grinding operation is disclosed.

Figure 1:
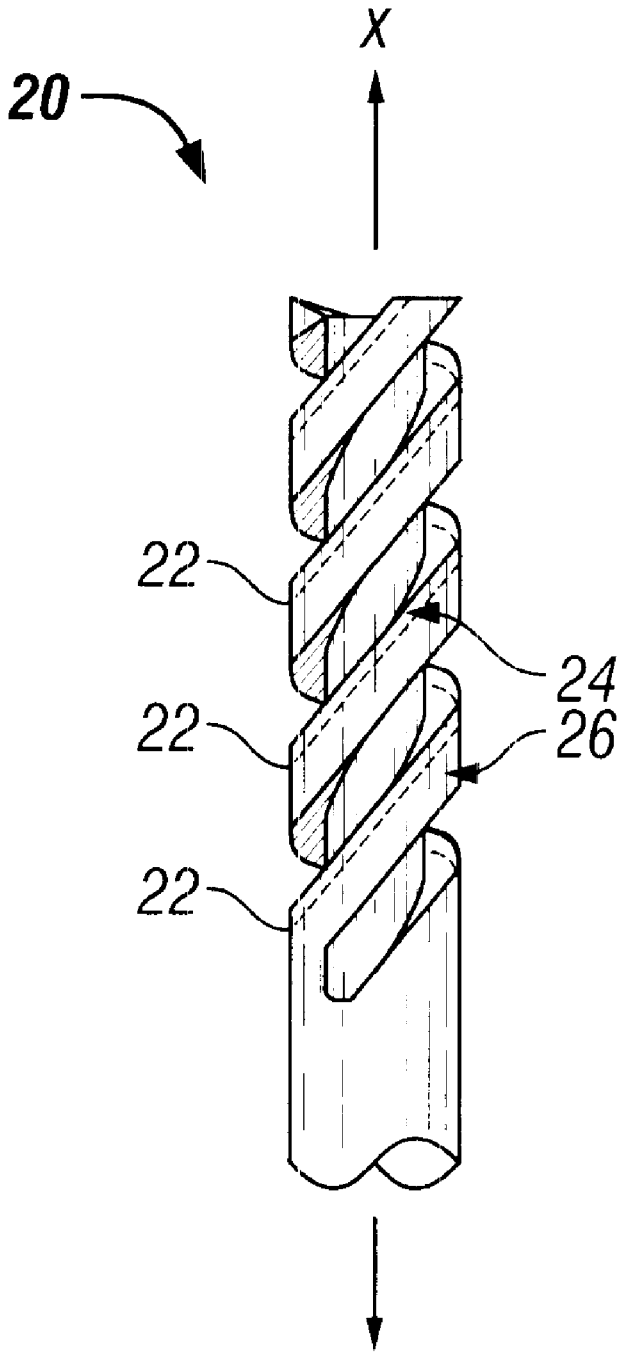
FIG. 1 (Prior Art)
FIG. 1 is a side elevational view of an end mill.

FIG. 1 is a side elevational view of an end mill 20. The end mill is a cutting tool that removes metal to precision tolerances. The end mill cuts metal using sharp teeth on both the sides and end of the tool. The end mill resembles a drill having a plurality of flutes 22 which are spiraling ridges running the entire length of the end mill. Each flute includes two angled edges, a primary clearance 24 and a secondary clearance 26. The primary and secondary clearances provide most of the cutting during the operation of the end mill on a work piece. The primary clearance is the uppermost cutting surface located on each flute, which includes a smaller width and shallower slope than the secondary clearance. The secondary clearance is also located on each flute, adjacent to the primary clearance. Typically, end mills include both a primary and secondary clearance. A secondary clearance is normally included on the flute of the end mill to prevent or reduce the likelihood of chip removal. Additionally, heat dissipating characteristics are also enhanced with the inclusion of a secondary clearance.

Since the primary and secondary clearances provide the cutting surfaces, they frequently wear down. In order to keep the end mill in optimum condition, the exterior surface of the end mill, and more specifically the primary and secondary clearances, must be periodically grinded or sharpened.

Figure 2:
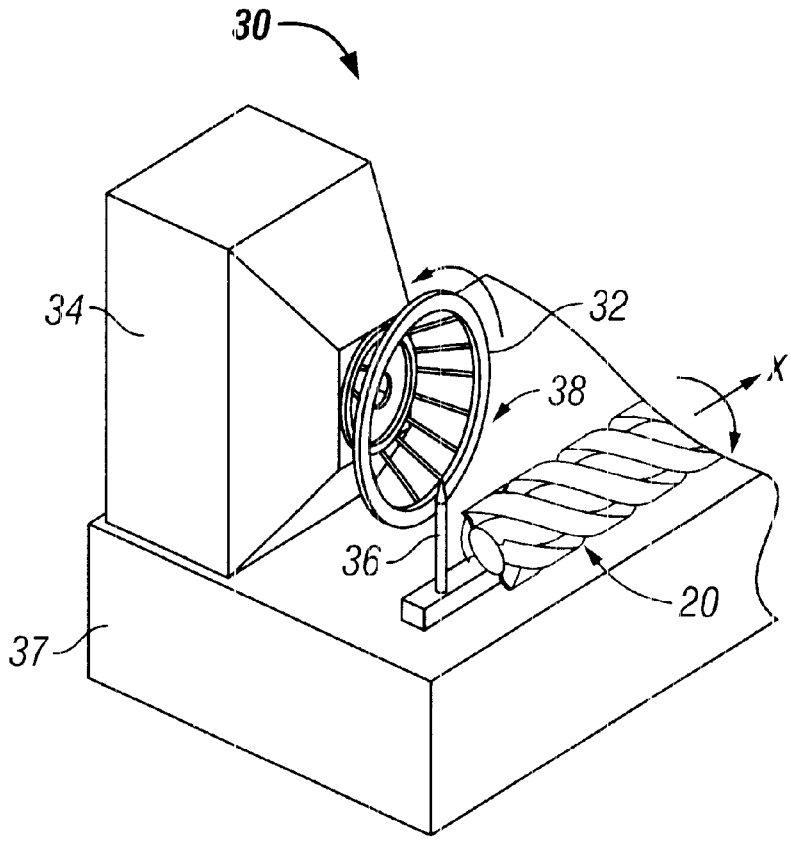
FIG. 2 (Prior Art)
FIG. 2 is a front perspective view of an existing art grinding machine with the end mill.

FIG. 2 is a front perspective view of an existing art grinding machine 30 with the end mill 20. The grinding machine includes a cup wheel 32 attached to a motor 34. A finger guide 36 is fixed to a base 37 positioned adjacent to the cup wheel 32. The finger guide remains stationary with respect to the cup wheel during the grinding operation. The cup wheel is rotationally driven about its longitudinal axis by the motor 34. An outer rim 38 having an abrasive surface is located on the end mill.

Figure 3:
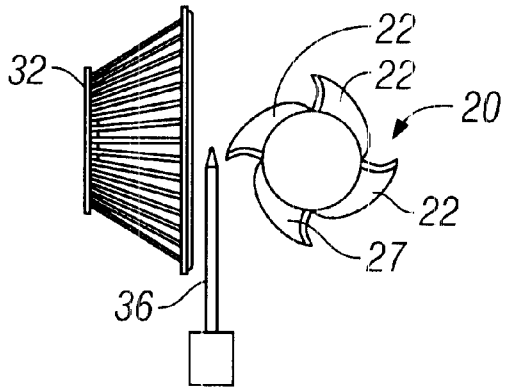
FIG. 3 (Prior Art)
FIG. 3 is a side view of the cup wheel of FIG. 2 engaging the end mill.

FIG. 3 is a side view of the cup wheel 32 of FIG. 2 engaging the end mill 20. In operation, the operator guides the end mill towards the rotating cup wheel 32. The operator simultaneously moves the end mill forward along the X axis and rotates the end mill about its X axis. The finger guide follows one of the flutes 22. The finger guide is adjusted to allow the rotating cup wheel to contact the spiraling flute along the outer rim 38. However, in order to grind the primary and secondary clearances, the operator must conduct a two step operation. First, the operator adjusts the finger guide to allow the cup wheel to grind the primary clearance. The operator then grinds the primary clearances of the end mill. In the second step, the operator readjusts the finger guide to allow the outer rim to contact the flute to allow grinding of the secondary clearances of the end mill. The operator then grinds the end mill in a second step.

The grinding machine 30 suffers from several disadvantages. First, the operator must grind the primary and secondary clearances in two steps. By requiring the end mill to be grinded in two steps, the entire process takes twice as long, which can be very costly and time consuming. Additionally, as discussed above, the finger guide is fixed in relation to the cup wheel. Although the finger guide can be adjusted to determine where the cup wheel contacts the end mill, once the grinding process begins, the operator must engage the cup wheel with the end mill by positioning a flute 22 of the end mill on the stationary finger guide. There is a tendency, with the stationary finger guide, for the operator to misplace the flute into the finger guide, causing gouging of the end mill. Thus the grinding machine 30 provides a costly and inefficient method of grinding end mills.

Figure 4:
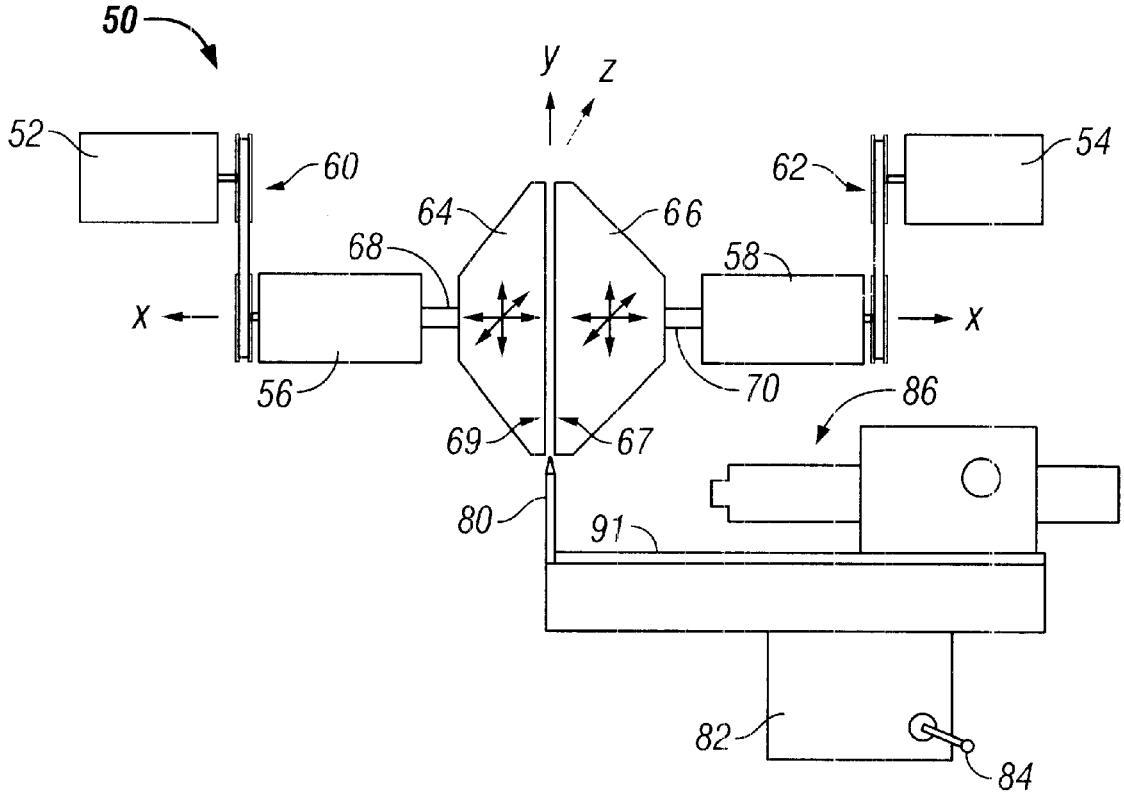
FIG. 4 is a front elevational view of an end mill grinder in the preferred embodiment of the present invention.

FIG. 4 is a front elevational view of an end mill grinder 50 in the preferred embodiment of the present invention. The grinder includes two motors 52 and 54, two spindles 56 and 58, two drive belt assemblies 60 and 62, and two wheels 64 and 66. Each motor drives its respective spindle, which rotates its associated wheel. Preferably, each wheel is "dish-shaped," which allows each wheel to be attached by a locking nut to associated axles 68 and 70 and have outer rims 65 and 67 of the wheels to be positioned adjacent and face-to-face to each other. However, in alternate embodiments, the wheels may be any size or shape having a circular rim to contact the end mill. Preferably, each wheel is made of a hard substance, such as borazon or diamond. The outer rims may also be constructed of an abrasive material. Since two wheels are utilized, the wheels are oriented 90 degrees away from existing grinding mills, such as illustrated in FIG. 2. The orientation of the two wheels allows the outer rims to both contact and grind the end mill in different locations (i.e., at the primary and secondary clearances). Additionally, each wheel may be independently adjusted in the X, Y, and Z axes (vertically, horizontally, and laterally) The adjustment and movement of the wheels is well known in the art and may be accomplished by any device providing movement of the wheels, such as adjustment knobs attached to geared platforms affixed to the axles to move the wheels or entire motor-spindle-drive belt assembly.

In the preferred embodiment of the present invention, each motor independently drives its associated wheel 64 or 66 along the wheel's X axis in counter rotation to its opposing wheel. In addition, although a belt assembly system is illustrated, it should be understood that any drive system which provides rotation to the wheels 64 and 66 may be utilized, such as a direct drive system.

Still referring to FIG. 4, a finger guide 80 is attached to a carriage 82, such as an air bearing fixture, which is well know in the art of end mill grinders. The finger guide and carriage may be adjusted vertically, horizontally, and laterally in relation to the wheels 64 and 66, typically by utilizing one or more crank handles 84. The carriage also includes an end mill retainer 86 for holding an end mill in place during the grinding operation. As is well known in the art, the end mill retainer can move the end mill horizontally and also rotate the end mill. The end mill retainer may be located on a rail 91, allowing movement of the retainer along the X axis of the carriage.

Figure 5:
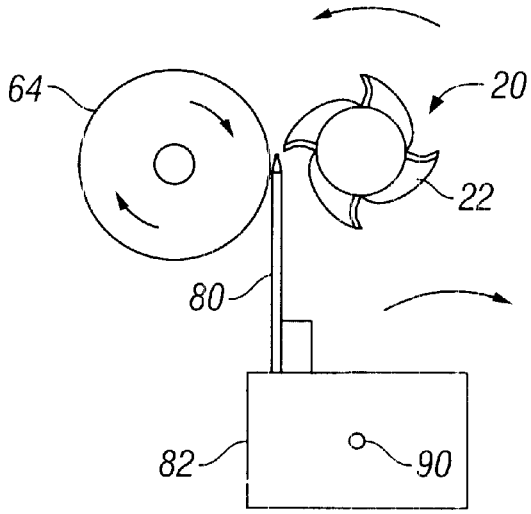
FIG. 5 is an isolated side view of the wheel engaging the end mill in the preferred embodiment of the present invention.

FIG. 5 is an isolated side view of the wheel 64 engaging the end mill 20 in the preferred embodiment of the present invention. As illustrated, the wheel 64 is rotated in one direction about its central axis (X-axis). In similar fashion to the grinding machine 30, the end mill is guided by the finger guide 80 along one of its flutes 22. The carriage, along with the finger guide, in addition to moving horizontally and vertically relative to the wheels, can also be rotated about a pivot point 90 of the carriage.

With reference to FIGS. 4 and 5, the operation of the end mill grinder 50 will now be explained. The operator independently adjusts the position of each wheel 64 and 66 to accommodate grinding the primary and secondary clearances 24 and 26 of the end mill 20. The operator must independently adjust the position of the wheels for different sizes of end mills. The operator positions the end mill within the end mill retainer 86 by rotating the carriage 82 away from the wheels 64 and 66. The operator then positions one of the flutes 22 on the finger guide 80. The operator engages the motors, thus rotating the wheels in opposite directions. The operator rotates the carriage about the pivot point 90 back towards the rotating wheels. The end mill then contacts the wheels along the primary clearances and the secondary clearances. For example, wheel 64 grinds the primary clearances of the end mill while the wheel 66 grinds the secondary clearances. Since the end mill is already positioned on the finger guide prior to contacting the wheels, the grinding wheel is prevented from gouging the end mill due to misplacement of the end mill on the finger guide as in existing grinders. The operator, in similar fashion as existing grinders, moves the end mill and its retainer 86 forward along its X axis while simultaneously rotating the end mill, with the finger guide following one of the spiraling flutes. Thus, the end mill's entire length of primary and secondary clearances are ground. In the preferred embodiment of the present invention, the wheels are rotated in opposite directions to avoid unbalanced torque or force being applied to the end mill during the grinding operation, which may occur if the wheels are rotated in the same direction. Since the primary and secondary clearances are ground simultaneously, the operator need only perform the grinding operation once.

The end mill grinder 50 provides many advantages over existing grinders. The end mill grinder allows the grinding operation of end mills in one step. Additionally, the end mill grinder 50, by utilizing independently adjustable wheels, may be used on end mills of different sizes without changing wheels to accommodate various sizes and shapes of end mills. The end mill grinder 50 also prevents the inadvertent misplacement of the end mill on the finger guide during the grinding operation, thus preventing accidental gouging of the end mill. In alternate embodiments, the end mill grinder 50 may be used on a variety of cutting tools having spiraling cutting surfaces requiring grinding.

It is thus believed that the operation and construction of the present invention will be apparent from the foregoing description. While the apparatus and method shown and described has been characterized as being preferred, it will be readily apparent that various changes and modifications could be made therein without departing from the scope of the invention as defined in the following claims.

What is claimed is:

1. An end mill grinder for grinding an end mill having a plurality of primary and secondary clearances, the end mill grinder comprising:

a first grinding wheel for grinding the primary clearances of the end mill;

a second grinding wheel for grinding the secondary clearances of the end mill, said second grinding wheel located adjacent to said first grind wheel;

means for rotating said first grinding wheel;

means for rotating said second grinding wheel;

a carriage located adjacent to said first and second grinding wheels;

a finger guide attached to the carriage, said finger guide guiding the end mill moving towards said first and second grinding wheels to simultaneously allow said first grinding wheel to grind the primary clearances and said second grind wheel to grind the secondary clearances of the end mill; and an end mill retainer for holding the end mill, said end mill retainer attached to the carriage.

2. The end mill grinder of claim 1, wherein a position of said carriage is adjustable in relation to said first and second grinding wheels.

3. The end mill grinder of claim 1, wherein said carriage is rotatable, thereby allowing the end mill to be positioned on said finger guide prior to contacting said first and second grinding wheels.

4. The end mill grinder of claim 1, wherein the end mill retainer allows rotational and longitudinal movement of the end mill in relation to said first and second grinding wheels.

5. The end mill grinder of claim 1, further comprising means for independently adjusting a position of the first grinding wheel.

6. The end mill grinder of claim 1, further comprising means for independently adjusting a position of the second grinding wheel.

7. The end mill grinder of claim 1, wherein said means for rotating said first grinding wheel includes:

a motor;

a spindle attached to said first grinding wheel; and a belt assembly attached to the motor and the spindle, the belt assembly allowing the motor to drive the spindle.

8. The end mill grinder of claim 1, wherein said means for rotating said first grinding wheel includes a motor for rotationally driving said first grinding wheel.

9. The end mill grinder of claim 1, wherein said means for rotating said second grinding wheel includes:

a motor;

a spindle attached to said second grinding wheel; and a belt assembly attached to the motor and the spindle, the belt assembly allowing the motor to drive the spindle.

10. The end mill grinder of claim 1, wherein said means for rotating said second grinding wheel includes a motor for rotationally driving said second grinding wheel.

11. The end mill grinder of claim 1, wherein said first and second grinding wheels are constructed of diamond.

12. The end mill grinder of claim 1, wherein said first and second grinding wheels are constructed of borazon.

13. The end mill grinder of claim 1, wherein said first grinding wheel is rotated in an opposite direction to said second grinding wheel.

14. An end mill grinder for grinding an end mill having a plurality of primary and secondary clearances, the end mill grinder comprising:

a first grinding wheel for grinding the primary clearances of the end mill;

a second grinding wheel for grinding the secondary clearances of the end mill, said second grinding wheel located adjacent said first grind wheel;

means for rotating said first grinding wheel;

means for rotating said second grinding wheel;

means for independently adjusting a position of the first grinding wheel;

means for independently adjusting a position of the second grinding wheel;

a carriage located adjacent to said first and second grinding wheels, said carriage having a finger guide and being rotatable to allow the end mill to be positioned on said finger guide prior to contacting said first and second grinding wheels;

the finger guide guiding the end mill to simultaneously allow the first grinding wheel to grind the primary clearances and the second grinding wheel to grind the secondary clearances of the end mill; and an end mill retainer attached to the carriage for holding the end mill, said retainer allowing rotation and horizontal movement of the end mill.

15. The end mill grinder of claim 14 wherein the means for rotating said first grinding wheel includes:

a motor;

a spindle attached to said first grinding wheel; and a belt assembly attached to the motor and the spindle, the belt assembly allowing the motor to drive the spindle.

16. The end mill grinder of claim 14 wherein the means for rotating said second grinding wheel includes:

a motor;

a spindle attached to said second grinding wheel; and a belt assembly attached to the motor and the spindle, the belt assembly allowing the motor to drive the spindle.

17. A method of grinding a plurality of primary clearances and secondary clearances of an end mill in one grinding process, said method comprising the steps of:

adjusting a position of a first grinding wheel in relation to a second grinding wheel, said position allowing an outer edge of the first grinding wheel to grind the primary clearance of the end mill and an outer edge of the second grinding wheel to grind the secondary clearance of the end mill;

affixing the end mill to a carriage having a finger guide;

rotating the first and second grinding wheels;

rotationally and horizontally translating the end mill to contact the rotating first and second grinding wheels, the first grinding wheel grinding the primary clearances and the second grinding wheel grinding the secondary clearances of the end mill.

* * * * *